United States Patent [19]

Johnson

[11] 4,043,566

[45] Aug. 23, 1977

[54] SKATEBOARD

[76] Inventor: Noel K. Johnson, 1370 Beryl, San Diego, Calif. 92109

[21] Appl. No.: 680,967

[22] Filed: Apr. 27, 1976

[51] Int. Cl.[2] ..... B62B 7/00

[52] U.S. Cl. ..... 280/87.04 A; 188/5

[58] Field of Search ..... 280/87.04 A, 87.04 R, 280/11.2, 11.21; 188/5, 6

[56] References Cited

U.S. PATENT DOCUMENTS

| | | | |
|---|---|---|---|
| 1,801,230 | 4/1931 | Fehre | 280/11.21 |
| 2,315,342 | 3/1943 | Liberman | 280/11.2 |
| 2,449,336 | 9/1948 | Spitzwieser | 280/87.04 R |
| 3,197,227 | 7/1965 | Anselmo | 188/5 X |
| 3,288,251 | 11/1966 | Sakawa | 280/87.04 A |

*Primary Examiner*—Philip Goodman
*Assistant Examiner*—John A. Pekar
*Attorney, Agent, or Firm*—Allen D. Brufsky

[57] ABSTRACT

A skateboard including a brake assembly for slowing and stopping the vehicle. A pivotal member on the board is provided with a depending rubber stop for engagement with the ground surface when the member is tilted by the heel of the shoe of the skater.

5 Claims, 4 Drawing Figures

SKATEBOARD

BACKGROUND OF THE INVENTION

This invention relates to a skateboard, and more particularly, a skateboard having a novel brake assembly.

Skateboarding has become a popular sport with teenagers, sub-teenagers and also some of the more sportsminded adults. In learning how to ride a skateboard, and even after a person becomes proficient in the use of a skateboard, it often becomes necessary to stop the board abruptly to avoid danger, as for example, when an impediment is suddenly thrust into the board's path of movement.

The only way to stop skateboards in use today, while the riser is still mounted on the board is to drag a foot along the ground surface or dismount and let the board contact an obstruction in the path of movement. Neither method is safe.

SUMMARY OF THE INVENTION

Accordingly, this invention provides a skateboard with one or more brakes, which can be actuated by the foot of the mounted user to stop the skateboard. The brake assembly includes a pivotal member on the board having a rubber stop for engaging the ground surface when the member is tilted by the heel of the shoe of the skater, to safely slow the board to a stop.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
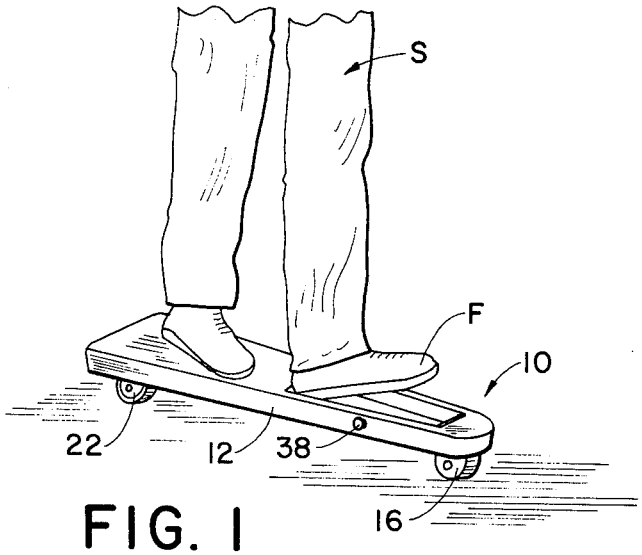
FIG. 1 is a perspective view of the skateboard of the present invention.
Figure 2:
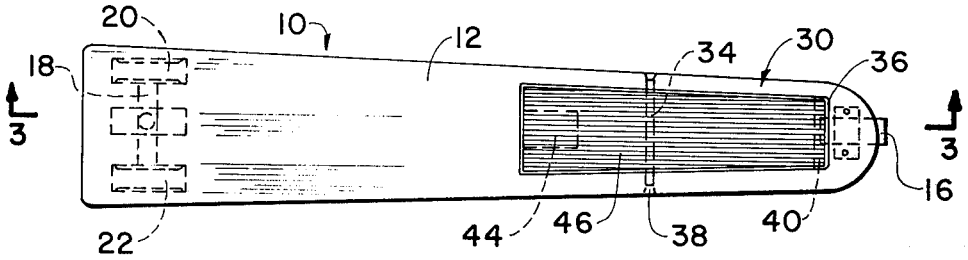
FIG. 2 is a top plan view of the skateboard of FIG. 1.

Referring now to the drawing in detail, wherein like numerals indicate like elements throughout the several views, the numeral 10 generally designates a conventional form of skateboard including an elongated, tapered, panel-like body 12 having a rear depending wheel truck 14 and a single front depending wheel 16.

The rear truck 14 includes the usual pivotally supported axle assembly 18 having dual wheels 20 and 22 journaled thereon. Front wheel 16 is journaled on an axle 24 supported by brackets 26 attached to the tip 28 of skateboard 10.

A brake assembly 30 is provided on skateboard 10 to slow and stop the skateboard, as desired, by a mounted skater S. Brake assembly 30 includes a pivotal member 32 which is tiltable by the hill of the foot F of skater S about a hinge pin 34, which mounts member 32 on skateboard 10.

Member 32 is cut from the interior of panel-like body 12 and is complemental in shape to the opening 36 left in body 12. Pin 34 is inserted through an opening 38 in body 12 and a corresponding aligned opening in member 32.

Figure 3:
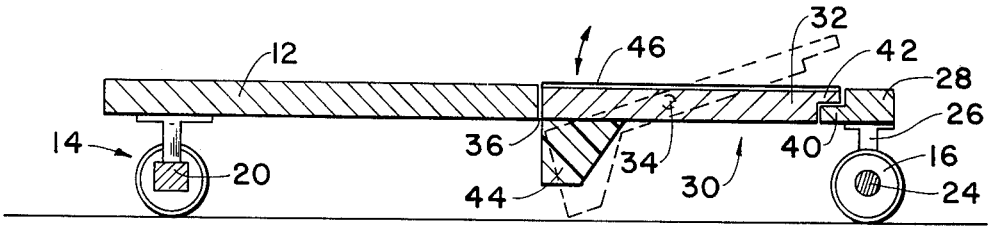
FIG. 3 is a cross-sectional view taken substantially along the plane indicated by line 3—3 of FIG. 2.

Member 32 is tiltable about pin 34 only in a rearward or counterclockwise direction, as viewed in FIG. 3, from a horizontal position wherein its top surface is flush with the top surface of the panel-like body 12. To accomplish this function, tip 28 includes a rearwardly projecting shoulder 40, which receives in abutment a forwardly projecting lip 42 on member 32 when member 32 is in a horizontal position. Shoulder 40 acts as a stop for clockwise rotation of member 32 by its abutment with lip 42.

Depending from the rear bottom surface of member 32 is a rubber stop 44. Stop 44 is in the shape of a trincated tetrahedron and when member 32 is tilted in a counterclockwise direction, as viewed in FIG. 3, stop 44 will engage the ground surface to act as a brake for skateboard 10, as shown by the phantom lines in FIG. 3.

In use, the skater S mounts skateboard 10 with both feet on the board and coasts down an incline. The heel of foot F is positioned on the rear portion of member 32. The top surface of member 32 can be provided with a rubber pad 46 to increase the friction between the shoe on foot F and member 32. If it is desired to slow skateboard 10 or stop it completely, skater S tilts member 32 about pin 34 so rubber stop 44 will drag along the ground surface. Otherwise, member 32 is retained in its normal horizontal position, with lip 42 in abutment with shoulder 40.

Figure 4:
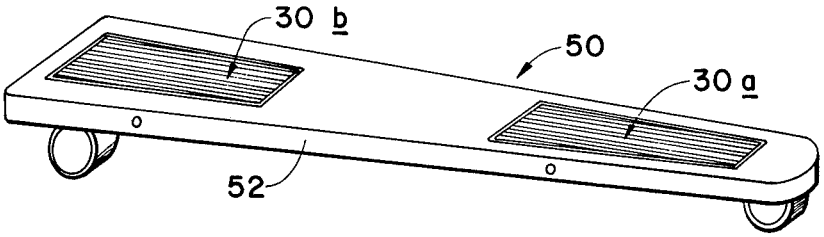
FIG. 4 is a perspective view of a modified form of the skateboard of the invention.

For greater braking power a skateboard 40, shown in FIG. 4, can be provided with two brake assemblies **30*a* and 30*b* at the front and rear of panel-like body 52, respectively. Each of the feet of skater S can operate one of the assemblies. In all other respects, each of the brake assemblies 30*a* and 30*b* is identical to brake assembly 30.**

I claim:

1. A skateboard comprising:

a low elongated substantially horizontal body having a front and a rear end, front and rear ground engaging support wheel means carried by corresponding end portions of said body, said support wheel means being adapted to support a load thereon, and brake means on said body for slowing said body by engagement with the ground in response to pivotal movement thereof by the load supported on said body, said brake means including a substantially planar member having a front and rear portion pivotally mounted in an opening in said body, and a depending stop member on the rear portion of said planar member, the front end of said body including a rearwardly projecting shoulder for abutting engagement with a forwardly projecting lip on the front portion of said planar member when said planar member is in a substantially horizontal position.

2. A skateboard is accordance with claim 1 wherein said stop member is rubber.

3. A skateboard in accordance with claim 1 wherein said stop member is a truncated tetrahedron.

4. A skateboard in accordance with claim 1 wherein said stop member is formed from friction generating material.

5. A skateboard in accordance with claim 1 wherein said planar member includes a rubber pad on its upper surface.

* * * * *